US006668597B2

(12) United States Patent
Robinson

(10) Patent No.: US 6,668,597 B2
(45) Date of Patent: Dec. 30, 2003

(54) CROCHET HOOK ASSEMBLY AND METHOD OF MAKING SAME

(75) Inventor: John S. Robinson, Berne, IN (US)

(73) Assignee: DRG Texas, LP, Big Sandy, TX (US)

( * ) Notice: Subject to any disclaimer, the term of this patent is extended or adjusted under 35 U.S.C. 154(b) by 0 days.

(21) Appl. No.: 10/318,720

(22) Filed: Dec. 13, 2002

(65) Prior Publication Data

US 2003/0121291 A1 Jul. 3, 2003

Related U.S. Application Data

(60) Provisional application No. 60/340,568, filed on Dec. 14, 2001.

(51) Int. Cl.[7] ..... D04B 35/02
(52) U.S. Cl. ..... 66/118
(58) Field of Search ..... 66/1 A, 116, 117, 66/118, 1 R; 163/2

(56) References Cited

U.S. PATENT DOCUMENTS

| | | | | | |
|---|---|---|---|---|---|
| 2,507,174 | A | * | 5/1950 | Phillips | 66/118 |
| 2,695,506 | A | * | 11/1954 | Kohlmann | 66/117 |
| 4,341,094 | A | * | 7/1982 | Heide | 66/117 |
| 4,646,543 | A | * | 3/1987 | Okada | 66/117 |
| 5,720,187 | A | * | 2/1998 | Matuo | 66/117 |
| 6,397,640 | B1 | * | 6/2002 | Williams | 66/117 |

* cited by examiner

*Primary Examiner*—Danny Worrell
(74) *Attorney, Agent, or Firm*—Barnes & Thornburg

(57) ABSTRACT

A crochet hook assembly has first and second hook bodies, an elongate flexible center, and a swivel. The flexible center has a first end coupled to the first hook body and a second end coupled to the second hook body to form a double hook subassembly. The swivel is disposed in the subassembly so as to allow one portion thereof to rotate relative to another. Additional swivels disposed along the length of the subassembly may be provided.

21 Claims, 2 Drawing Sheets

CROCHET HOOK ASSEMBLY AND METHOD OF MAKING SAME

RELATED APPLICATION

The present application is related to and claims priority to U.S. Provisional Patent Application, Ser. No. 60/340,568, filed on Dec. 14, 2001, entitled Double Crochet Hook With Rotating Flexible Cable. The subject matter disclosed in that provisional application is hereby expressly incorporated into the present application.

TECHNICAL FIELD

The present disclosure relates generally to a crochet hook assembly, and more particularly, to a crochet hook assembly having hooks on both ends.

BACKGROUND OF THE INVENTION

Double crochet hooks generally include a solid shaft with a hook on each end. The double hook allows a person to crochet from either end of the hook with the item being crocheted held on the shaft.

SUMMARY OF THE INVENTION

The present invention provides a double crochet hook with a flexible center. In one embodiment, the double hook includes a pair of relatively rigid hook bodies connected by a flexible cable. The flexible cable facilitates the crocheting of large projects and allows the person to rest a portion of the project in their lap taking the weight of the yarn off the person's shoulders and wrists. At least one connection of the flexible cable to one of the hook bodies allows the cable to rotate axially in relation to the hook body. The flexible cable is adapted to transmit axially rotative forces to one or more swivels connecting the hook bodies to the flexible cable to prevent the kinking and twisting of the flexible cable while a person is corcheting. Thus, the cable provides means for transmitting rotative forces to a swivel. The swivel(s) prevent the kinking and twisting of the flexible cable, which eliminates the twisting of the hook bodies, and takes additional strain off the person's hands and wrists.

One embodiment of the present invention provides a double crochet hook comprising a pair of hook bodies connected by a flexible cable at a pair of connection points. At least one of the connection points allows the flexible cable to rotate axially in relation to at least one of the hook bodies.

Another embodiment of the present invention provides a double crochet hook comprising a pair of hook bodies intermediately connected by a flexible cable, and having at least one swivel connecting the flexible cable to one of the hook bodies.

Still another embodiment of the present invention provides a double crochet hook comprising a pair of hook bodies, a flexible cable, and a pair of swivels each connecting one end of the flexible cable to one of the hook bodies.

Additional embodiments, features and advantages will become apparent to those skilled in the art upon consideration of the following description of the illustrated embodiment exemplifying the best mode of carrying out the invention.

BRIEF DESCRIPTION OF THE DRAWINGS

The present invention will be described hereafter with reference to the attached drawings which are given as a non-limiting example only, in which.

This exemplification set out herein illustrates an embodiment of the invention that is not to be construed as limiting the scope of the invention in any manner.

DESCRIPTION OF EMBODIMENTS OF THE INVENTION

The embodiments described herein are not intended to be exhaustive or to limit the invention to the precise forms disclosed.

Figure 1:
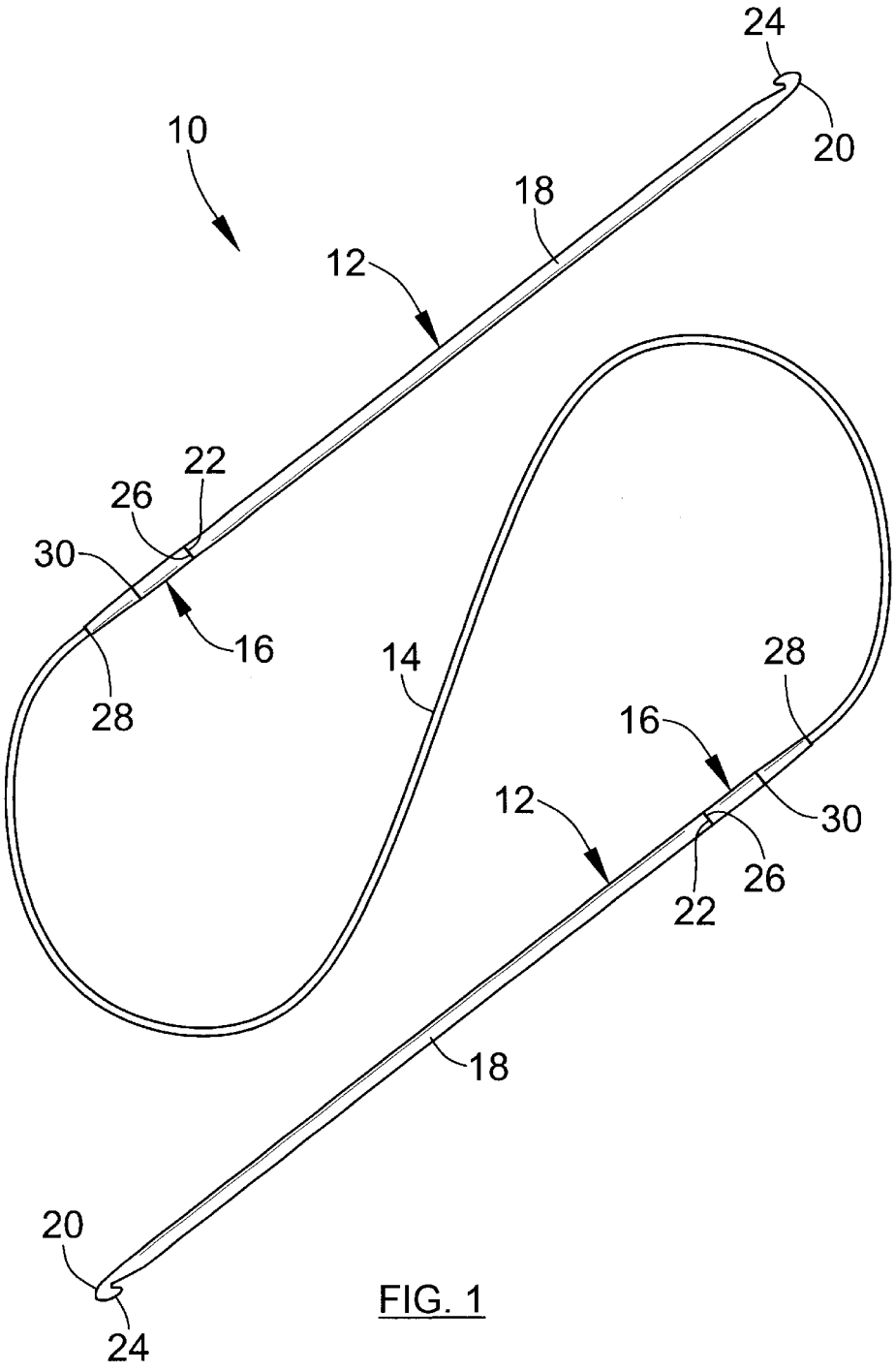
FIG. 1 is a perspective view of a double crochet hook having a pair of swivels according to the present invention.

FIG. 1 shows a double crochet hook 10 according to the present invention. Double crochet hook 10 includes a pair of relatively rigid hook bodies 12 connected with a flexible cable 14. Connecting hook bodies 12 to flexible cable 14 is a pair of swivels 16. Each hook body 12 includes a shaft 18 with first and second ends 20, 22, respectively, and a hook 24 on first end 20. Each of the swivels 16 has a first end 26 connected to second end 22 of hook body 12, a second end 28 connected to an end of the flexible cable 14, and a swivel portion 30. Swivel portion 30 permits first end 26 of swivel 16 to freely rotate independently of second end 28 of swivel 16. The outside diameter of swivel 16 decreases from first end 26, which is substantially the same diameter as second end 22 of hook body 12, to second end 28, which is slightly larger than the diameter of flexible cable 14. A smooth profile is preferably maintained to prevent snagging or obstructing the item being crocheted. Each end of flexible cable 14 is inserted into one of the second ends 28 of swivel 16 and is attached thereto.

Hook body 12 is manufactured of an alloy, but other materials could be used, such as plastic, wood, or other suitable relatively rigid material. The diameter of shaft 18 and hook 24 is variable and depends on the desired type of crochet stitch. The length of hook body 12, typically around seven inches, provides comfortable use by allowing the person to hold the hook body and not the flexible cable.

Flexible cable 14 is a cable similar to the nylon line used in grass trimmers, but other plastic lines or suitable flexible lines could also be used. The diameter of flexible cable 14 is preferably limited to the diameter of hook body 12 when connected directly to the hook body or to the diameter of the second end of the swivel when a swivel is used. The length of flexible cable 14, typically around twenty inches, is variable to accommodate the size of the crocheting project.

Swivel 16 is also manufactured of an alloy, but other materials could be used, such as plastic or other suitable materials. The size of swivel 16 is dependent on the diameters of hook body 12 and flexible cable 14. Swivel portion 30 allows hook body 12 to rotate without rotating flexible cable 14, avoiding the kinking and twisting of flexible cable 14. This also adds to the comfort and ease of using double crochet hook 10, because flexible cable 14 will also not be translating any twisting or rotating to hook body 12.

Figure 2:
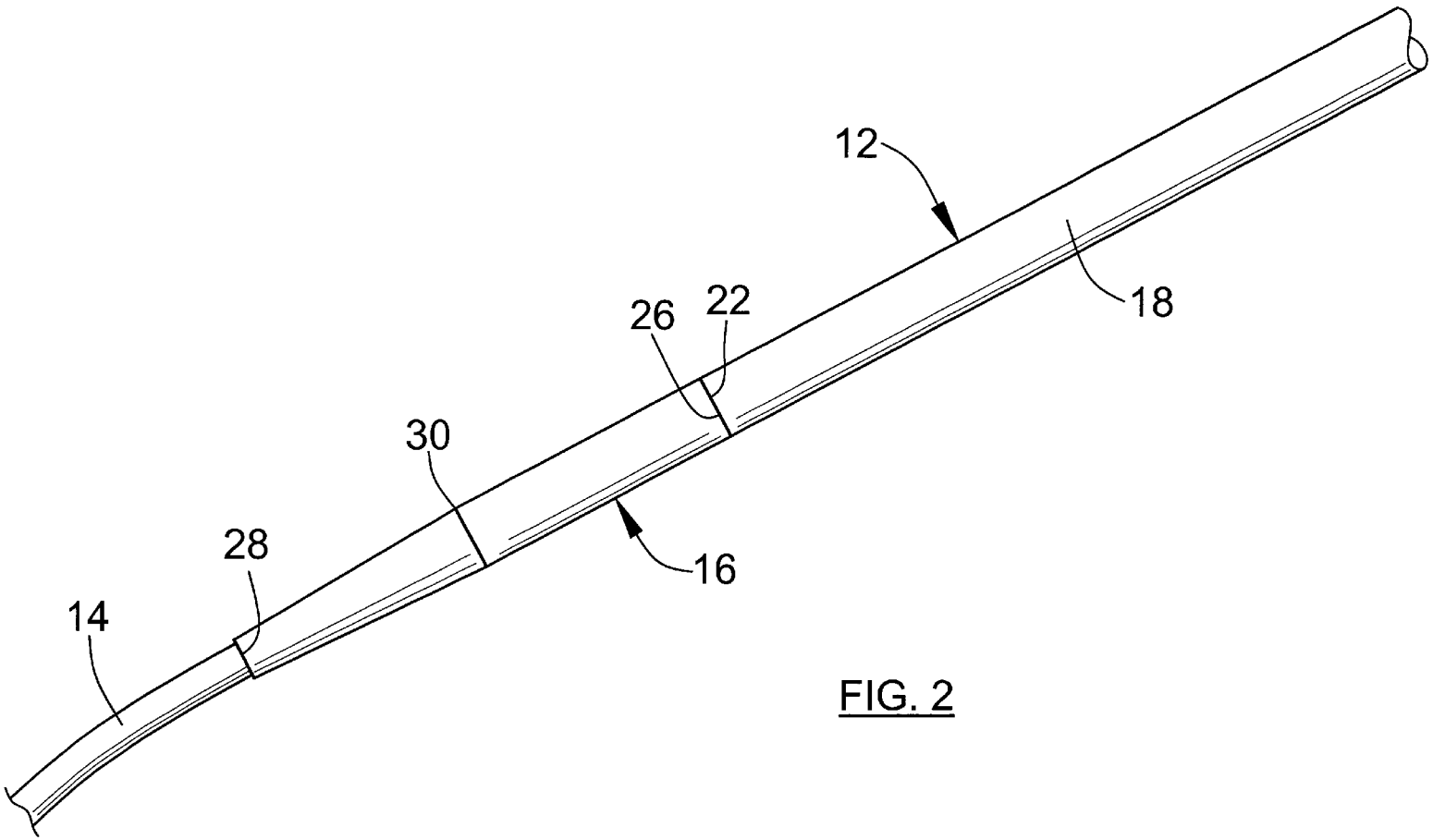
FIG. 2 is an enlarged view of one of the swivels of the double crochet hook of FIG. 1.

FIG. 2 shows an enlarged view of double crochet hook 10 at one of the swivels 16. The transitions at the connections points at swivel 16 to hook body 12 and flexible cable 14 are substantially flush, allowing the yarn to move along double crochet hook 10 without snagging. Second end 22 of hook body 12 and first end 26 of swivel 16 have substantially identical diameters to form a continuous even surface. The diameter of swivel 16 gradually decreases from first end 26 through swivel portion 30 to second end 28. The diameter of second end 28 of swivel 16 is slightly larger than the diameter of flexible cable 14, allowing an end of flexible cable 14 to be inserted into second end 28 of swivel 16 and attached to the interior of second end 28 of swivel 16.

Other embodiments of the present invention could include one swivel, three or more swivels, or no swivels if an alternative mechanism for allowing freedom of rotation of the cable and hook(s) is provided. The swivel(s) can be located at either or both of the connections between the hook body and the flexible cable, or can be incorporated along the length of the flexible cable itself.

While this invention has been described as having exemplary embodiments, this application is intended to cover any variations, uses, or adaptations using its general principles. Further, this application is intended to cover such departures from the present disclosure as come within the known or customary practice within the art to which it pertains.

Although the above description refers to particular means, materials and embodiments, one skilled in the art can easily ascertain the essential characteristics of the present invention. Various changes and modifications may be made to adapt to various uses and characteristics without departing from the spirit and scope of the present invention as set forth in the following claims.

What is claimed is:

1. A crochet hook assembly, comprising:

first and second hook bodies;

an elongate, flexible member having a first end coupled to the first hook body and a second end coupled to the second hook body to form a double hook subassembly;

the elongate flexible member being adapted so as prevent axial rotation along its length; and a swivel disposed in the subassembly so as to allow the first hook body to rotate relative to another portion of the subassembly.

2. The crochet hook assembly according to claim 1, wherein the swivel is disposed between an end of the first hook body and the flexible member.

3. The crochet hook assembly according to claim 1, further comprising a second swivel disposed in the subassembly.

4. The crochet hook assembly according to claim 3, wherein said swivel is disposed between an end of the first hook body and the flexible member, and said second swivel is disposed between an end of the second book body and the flexible member.

5. The crochet hook assembly according to claim 1, wherein the swivel is disposed along the length of the flexible member.

6. The crochet hook assembly according to claim 1, wherein the swivel is disposed between an end of the first hook body and the flexible member, and wherein an outside diameter of the swivel is substantially the same as an outside diameter of the first hook body.

7. The crochet hook assembly according to claim 6, wherein the outside diameter of the swivel decreases from a first end, which has a diameter substantially the same as an outside diameter of the first hook body, to a second end, which has an outside diameter substantially the same as or slightly larger than a diameter of the flexible member.

8. The crochet hook assembly according to claim 1, wherein the swivel is disposed in the subassembly in such a manner as to maintain a relatively smooth profile to reduce snagging or obstructing an item being crocheted.

9. The crochet hook assembly according to claim 1, wherein said flexible member is a cable.

10. The crochet hook assembly according to claim 1, wherein the first end of the flexible member is coupled to the first hook body by the swivel.

11. The crochet hook assembly according to claim 10, further comprising a second swivel, and wherein the second end of the flexible member is coupled to the second hook body by the second swivel.

12. The crochet hook assembly according to claim 1, wherein said hook bodies are formed of a relatively rigid material, such as metal, plastic or wood.

13. The crochet hook assembly according to claim 1, wherein the flexible member is a cable.

14. The crochet hook assembly according to claim 13, wherein the cable is formed of plastic, such as nylon.

15. The crochet hook assembly according to claim 1, further comprising a plurality of swivels disposed in the subassembly so as to allow portions of the subassembly to rotate relative to one another.

16. A method of making a crochet hook assembly, comprising the steps of:

a) providing first and second hook bodies;

b) providing an elongate, flexible member that is adapted to transmit axially rotative forces;

c) coupling a first end of the flexible member to the first hook body and a second end of the flexible member to the second hook body to form a double hook subassembly; and d) forming at least one swivel connection along the length of the subassembly so as to allow at least one portion of the subassembly to rotate relative to another portion whereby axial rotative forces on at least one of the first hook body, second hook body and flexible member are transmitted to the swivel.

17. The method of claim 16, wherein the step of coupling a first end of the flexible member to the first hook body and a second end of the flexible member to the second hook body to form a double hook subassembly comprises the additional steps of connecting the first end of the flexible member to one end of a swivel and connecting another end of the swivel to the first hook body.

18. The method of claim 17, further comprising the additional steps of connecting the second end of the flexible member to one end of a second swivel, and connecting another end of the second swivel to the second hook body.

19. The method of claim 16, comprising the additional step of maintaining a relatively smooth profile throughout the length of the double hook subassembly so as to reduce snagging or obstructing an item being crocheted.

20. A crochet hook assembly, comprising:

first and second hook bodies;

an elongate, flexible member having a first end coupled to the first hook body and a second end coupled to the second hook body to form a double hook subassembly; and a swivel disposed in the subassembly so as to allow the first hook body to rotate relative to another portion of the subassembly and the elongate flexible member having means for transmitting axial rotative forces to the swivel.

21. A method of making a crochet hook assembly, comprising the steps of:

a) providing first and second hook bodies;

b) providing an elongate, flexible member;

c) coupling a first end of the flexible member to the first hook body and a second end of the flexible member to the second hook body to form a double hook subassembly;

d) forming at least one swivel connection along the length of the subassembly so as to allow at least one portion of the subassembly to rotate relative to another portion; and e) providing means for transmitting axial rotative forces on at least one of the first hook body, second hook body and flexible member to the swivel.

* * * * *